US005805952A

United States Patent [19]

Buch et al.

[11] Patent Number: 5,805,952

[45] Date of Patent: Sep. 8, 1998

[54] IMAGING MATERIAL DETECTION IN A MAGNETIC WINDOW CLEANING DISPENSING CONTAINER

[75] Inventors: Douglas W. Buch, Webster; Gene S. Serafine, Henrietta; Rhonda L. Staudt, Webster; Timothy G. Struczewski, Rochester; Jack E. Van Duser, Webster, all of N.Y.

[73] Assignee: Xerox Corporation, Stamford, Conn.

[21] Appl. No.: 795,748

[22] Filed: Feb. 6, 1997

[51] Int. Cl.[6] ..... G03G 15/08

[52] U.S. Cl. ..... 399/27; 399/120; 399/262

[58] Field of Search ..... 399/27, 120, 262, 399/263; 222/DIG. 1

[56] References Cited

U.S. PATENT DOCUMENTS

| | | | |
|---|---|---|---|
| 3,920,155 | 11/1975 | Whited | 222/23 |
| 4,135,642 | 1/1979 | Forward, et al. | 222/23 |
| 4,989,754 | 2/1991 | Grasso et al. | 222/39 |
| 5,257,077 | 10/1993 | Peters, Jr. et al. | 355/260 |
| 5,495,323 | 2/1996 | Meetze, Jr. | 355/260 |
| 5,557,368 | 9/1996 | Endo et al. | 399/27 |

FOREIGN PATENT DOCUMENTS

| | | |
|---|---|---|
| 82-196274 | 12/1982 | Japan . |
| 62-289873 | 12/1987 | Japan . |
| 63-296070 | 12/1988 | Japan . |
| 4-311980 | 11/1992 | Japan . |
| 8-160698 | 6/1996 | Japan . |
| 8-220866 | 8/1996 | Japan . |

*Primary Examiner*—Arthur T. Grimley
*Assistant Examiner*—Quana Grainger

[57] ABSTRACT

A reproduction apparatus imaging material dispensing system has a replaceable and rotatable imaging material dispensing container from which an at least partially magnetically aitractable consumable imaging material is dispensed. There is an optical imaging material level sensing system mounted outside of the container for optically detecting the imaging material inside the container through translucent walls thereof and signaling an insufficient remaining quantity of imaging material. A magnetic brush cleaning system internally cleans imaging material from the inside of a annular translucent wall area of the container to provide and maintain relatively unobstructed such optical sensing. It can be provided by a stationary magnet mounted outside of but adjacent to the container to attract magnetically attractable imaging material to the inside of the container wall to form a magnetic cleaning brush to clean the translucent wall annular area. This allows a light receiving sensor on one side of the container to detecting light from a light emitter on the other side of the container through the magnetically cleaned translucent annular band. The magnet can extend substantially the full length of the outside of the container to clean the entire interior thereof.

2 Claims, 3 Drawing Sheets

IMAGING MATERIAL DETECTION IN A MAGNETIC WINDOW CLEANING DISPENSING CONTAINER

Disclosed in the embodiment herein is an improved imaging material dispensing system for a reproduction apparatus, such as a xerographic or other copier or printer, although not limited thereto, wherein a simple, low cost, magnetic brush self cleaning system is provided for automatically cleaning the inside of the imaging material dispensing container. Further disclosed is an optical sensing system for detecting the presence, absence, and/or level of toner or other consumable imaging materials inside an imaging material dispensing container from outside of the container, wherein a simple, low cost, magnetic brush self cleaning system is provided for automatically cleaning an optical window area inside of the imaging material dispensing container so that an optical sensing system externally of the container may be employed for optically sensing the presence, absence, and/or level of consumable imaging material inside of the container.

As is well known, it is desirable to provide a reliable means for determining when additional imaging material needs to be provided for or added to a reproduction apparatus which consumes such imaging material during sheet or web printing operations. Various "low toner", toner level or toner presence detecting systems have been developed and/or patented for xerographic copiers and printers which determine when the internal supply source of toner needs to be replenished, typically by signaling on an operator display the need for refilling or replacing a toner dispensing supply container when the undispensed toner therein approaches a preset low level or near empty state. Some examples include U.S. Pat. Nos. 3,920,155; 4,135,642; and 4,989,754. (This should be distinguished from alternative or additional systems for estimating the consumption of toner, as in U.S. Pat. No. 5,349,377 and other references cited therein.)

It is desirable that the toner level in the supply container sensing system be low cost and reliable, and not occluded or contaminated by the particulate toner material or the like. That is particularly a problem with an optical, i.e., light beam, sensing system since most imaging materials are effectively opaque. It is desirable for these and other reasons not to have any, or as few as possible, components of the optical sensing system within the imaging material dispensing container itself. Not only because the components within the supply container can become contaminated or jammed by the toner and/or other imaging materials, but also because it is desirable to make the imaging material supply container recyclable and of low cost. It is desirable that the imaging materials be added to the reproduction apparatus with as little spillage or contamination of the machine or the user as possible, preferably by removing a simple, low cost, empty imaging materials supply container and inserting a full container rather than pouring loose material into an open container in the machine.

Of particular background interest is U.S. Pat. No. 4,135,642, issued Jan. 23, 1979 to John E. Forward et al, which shown an optical automatic low toner level indicator with a lamp and photocell and a wiping arrangement provided inside the dispenser to periodically clean the windows thereof. This patent particularly illustrates some of the difficulties described above and elsewhere. If the toner level sensing system is of the optical type, especially one depending on the absence of interruption of a light beam by the toner in the container to indicate that the toner level has fallen below the desired level in the container or other input, it will be apparent from said U.S. Pat. No. 4,135,642 and elsewhere that contamination by the toner material of either the light emitter or light receiver or sensor can also block the light beam therebetween, and thus trick the optical sensing system into falsely signaling that there is still sufficient toner available in the toner container, when there is not.

As is well known, such toner level or low toner detection and indicating systems are desirable for warning the machine operator through a visual or other display of the impending exhaustion of the toner supply and the need for replacement. If the supply of toner becomes exhausted, there can be a perceptible reduction in the density of the developed image and thus a degradation in copy quality, with unacceptably light copies, and there may be a long recovery period until the added fresh toner achieves the proper ratio of carrier to developer in a two component developer mixing system such that adequate copy quality is re-achieved. That is, it is very undesirable to let the reproduction apparatus actually run out of toner. Thus, it is particularly important to have an accurate signal of the toner level reaching such a low level in the toner dispensing container that it should be replaced, i.e., an "early warning" of pending toner exhaustion.

By way of important background, various electrically biased magnet brush cleaning systems are known for the different application of cleaning residual toner from the surface of moving photoreceptor after the transfer of a toner image therefrom. One example is Xerox Corporation U.S. Pat. No. 4,116,555 issued Sep. 26, 1978 to Eugene F. Young, et al.

Further by way of background, the exemplary toner dispensing cylindrical rotating cartridge shown by way of one example hereinbelow of an imaging material dispensing system, and its function and associated apparatus, may be similar in other respects to that of Xerox Corporation U.S. Pat. No. 5,495,323 issued Feb. 27, 1996 to Murray O. Meetze, Jr. Thus, features thereof of only background interest to the present invention, such as its particular rotatable drive and integral internal auger for leveling and transporting toner therein to a dispensing outlet to replenish a development unit of a xerographic printer on controlled demand, etc., need not be re-described in detail herein. Another example of an internal auger rotating in with a cylindrical toner dispenser is disclosed in Xerox Corporation U.S. Pat. No. 5,257,077. The present invention is not limited to any such or other specific developer material dispensing system other than as indicated the claims.

A specific feature of the specific embodiment(s) disclosed herein is to provide an imaging material dispensing container from which an at least partially magnetically attractable consumable imaging material is dispensed for said reproduction apparatus, with an imaging material level sensing system for sensing when there is an insufficient quantity of said imaging material remaining in said imaging material dispensing container, wherein said imaging material level sensing system is positioned outside of said container to optically detect said insufficient quantity of said imaging material inside of said imaging material dispensing container from outside of said container; said imaging material dispensing container has at least one translucent wall area through which said imaging material level sensing system can optically detect the presence of said imaging material inside of said imaging material dispensing container; and a magnetic brush cleaning system for internally cleaning said imaging material from the inside of said translucent wall area of said imaging material dispensing container to maintain relatively unobstructed sensing of said imaging material by said imaging material level sensing system.

Further specific features disclosed herein, individually or in combination, include those wherein said imaging material dispensing container is rotatable, and wherein said magnetic brush cleaning system comprises a magnet positioned outside of and adjacent to said imaging material dispensing container to form a magnetic cleaning brush inside of said imaging material dispensing container by magnetically attracting said magnetically attractable imaging material to said translucent wall area of said imaging material dispensing container; and/or wherein said imaging material dispensing container is generally cylindrical and rotatable and said translucent wall area thereof comprises a translucent annular band portion thereof; and/or wherein said imaging material level sensing system comprises a light emitter source positioned on one side of said imaging material dispensing container and a light receiving sensor substantially spaced therefrom on an opposing side of said imaging material dispensing container for receiving and detecting light from said light emitter source through said imaging material dispensing container; and/or wherein said imaging material level sensing system comprises a light emitter source and a light receiving sensor, and said imaging material dispensing container is removably mounted between said light emitter source and said light receiving sensor; and/or wherein said imaging material sensing system comprises a light beam source and a light receiver substantially spaced therefrom for receiving and detecting the light beam from said light beam source; and wherein said imaging material dispensing container is removably mounted in the path of said light beam from said light beam source between said light beam source and said light receiver; and/or wherein said imaging material dispensing container is rotatably driven, and wherein said magnetic brush cleaning system comprises a stationary magnet mounted outside of and adjacent to said imaging material dispensing container to form a magnetic cleaning brush inside of said imaging material dispensing container by magnetically attracting said magnetically attractable imaging material to said translucent wall area of said imaging material dispensing container, and wherein said translucent wall area comprises a translucent annular band portion thereof, and wherein said imaging material level sensing system comprises a light emitter source positioned on one side of said imaging material dispensing container and a light receiving sensor substantially spaced therefrom on an opposing side of said imaging material dispensing container for receiving and detecting light from said light emitter source through said translucent annular band portion of said imaging material dispensing container cleaned by said magnetic cleaning brush; and/or wherein a reproduction apparatus imaging material dispensing system with an imaging material dispensing container from which an at least partially magnetically attractable consumable imaging material is dispensed for said reproduction apparatus, with an imaging material level sensing system for sensing when there is an insufficient quantity of said imaging material remaining in said imaging material dispensing container, and wherein said imaging material dispensing container is a generally cylindrical tubular container which is rotatably driven for said dispensing, a magnetic brush cleaning system is provided for internally cleaning said imaging material from the inside of said imaging material dispensing container, wherein said magnetic brush cleaning system comprises a stationary magnet mounted outside of and adjacent to said cylindrical imaging material dispensing container to form a magnetic cleaning brush inside of said imaging material dispensing container by magnetically attracting said magnetically attractable imaging material to said interior of said imaging material dispensing container to clean said interior of said imaging material dispensing container with said magnetic cleaning brush as said cylindrical imaging material dispensing container is so rotatably driven; and/or wherein said stationary magnet corresponds in length to the length of said cylindrical imaging material dispensing container.

The disclosed system may be connected to and operated and controlled by appropriate operation of conventional reproduction system control systems. It is well known and preferable to program and execute imaging, printing, paper handling, and other control functions and logic with software instructions for conventional or general purpose microprocessors, as taught by numerous prior patents and commercial products. Such programming or software may of course vary depending on the particular functions, software type, and microprocessor or other computer system utilized, but will be available to, or readily programmable without undue experimentation from, functional descriptions, such as those provided herein, and/or prior knowledge of functions which are conventional, together with general knowledge in the software and computer arts. Alternatively, the disclosed control system or method may be implemented partially or fully in hardware, using standard logic circuits or single chip VLSI designs. The resultant controller signals may conventionally actuate various conventional electrical solenoid or cam-controlled motors or clutches, or other components, in programmed steps or sequences.

As to specific components of the subject apparatus, or alternatives therefor, it will be appreciated that, as is normally the case, some such components are known per se in other apparatus or applications which may be additionally or alternatively used herein, including those from art cited herein, or commercially available components, such as well known light emitter-sensor pairs, and various well known magnets. All references cited in this specification, and their references, are incorporated by reference herein where appropriate for appropriate teachings of additional or alternative details, features, and/or technical background. What is well known to those skilled in the art need not be described here.

Various of the above-mentioned and further features and advantages will be apparent from the specific apparatus and its operation described in the example below, and the claims. Thus, the present invention will be better understood from this description of one specific embodiment, including the drawing figures (approximately to scale) wherein:

Describing now in further detail this exemplary embodiment with reference to the Figures, only the relevant portions are illustrated since there is no need to show the rest of an otherwise conventional reproduction machine and its imaging system, such as is already shown in the above-cited issued U.S. Pat. No. 5,498,323, etc. The reproduction machine is conventionally supplied with conventional consumable toner, or toner plus carrier, imaging material 12 from a generally cylindrical replaceable toner dispensing bottle or container 14 which is rotatably driven, as described in the above-cited U.S. Pat. No. 5,495,323 or otherwise. The improved optical toner level sensing system 20 of which only one example is shown here provides a simple yet more accurate early warning to the customer that this container 14 is empty, or about to become empty, and provides an internal self-cleaning function as well.

Figure 1:
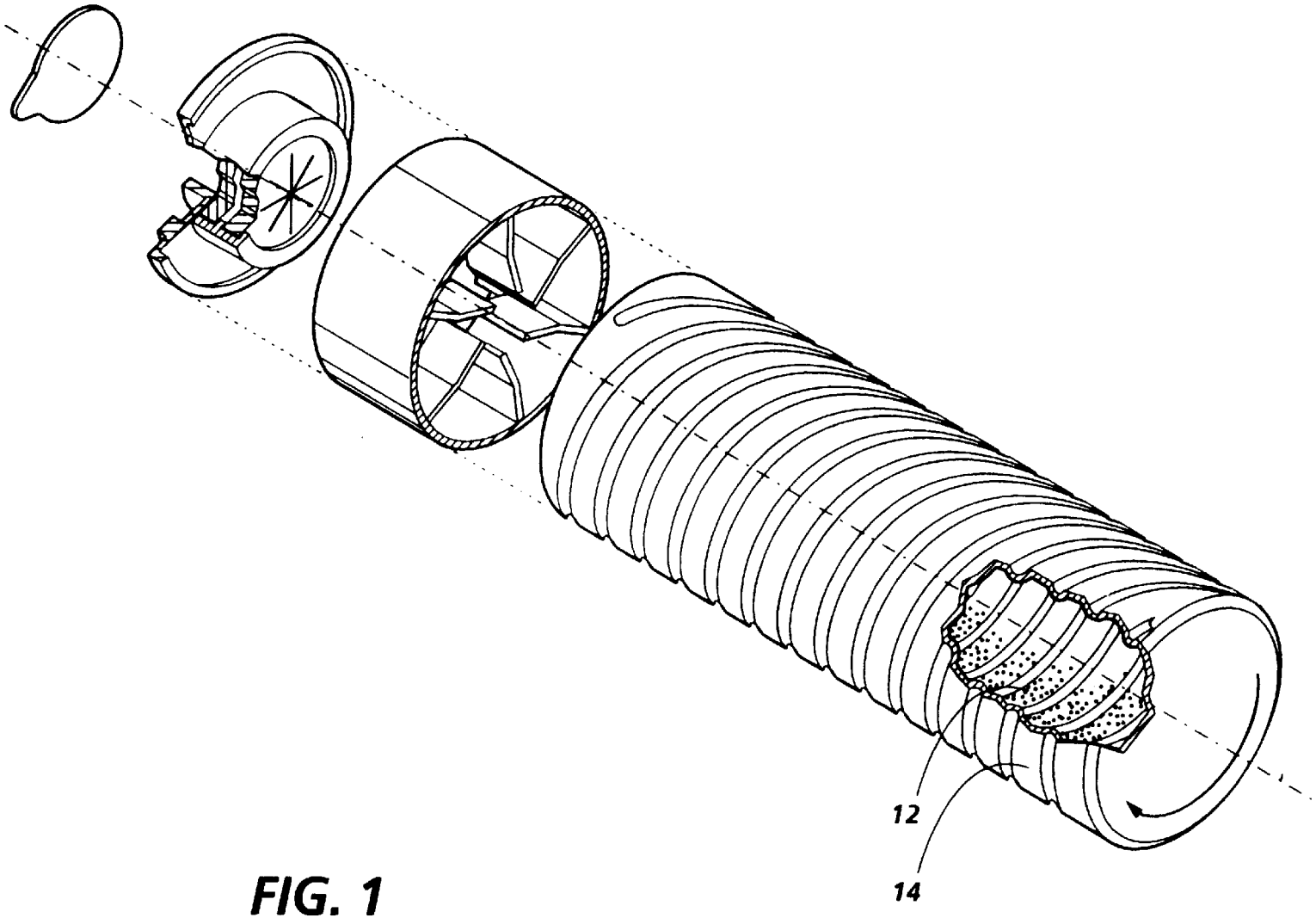
FIG. 1 is an exploded perspective view of one embodiment of an exemplary toner dispensing container for a xerographic reproduction apparatus for which the disclosed improved imaging materials level sensing system may be employed, as show in the other Figures.
Figure 2:
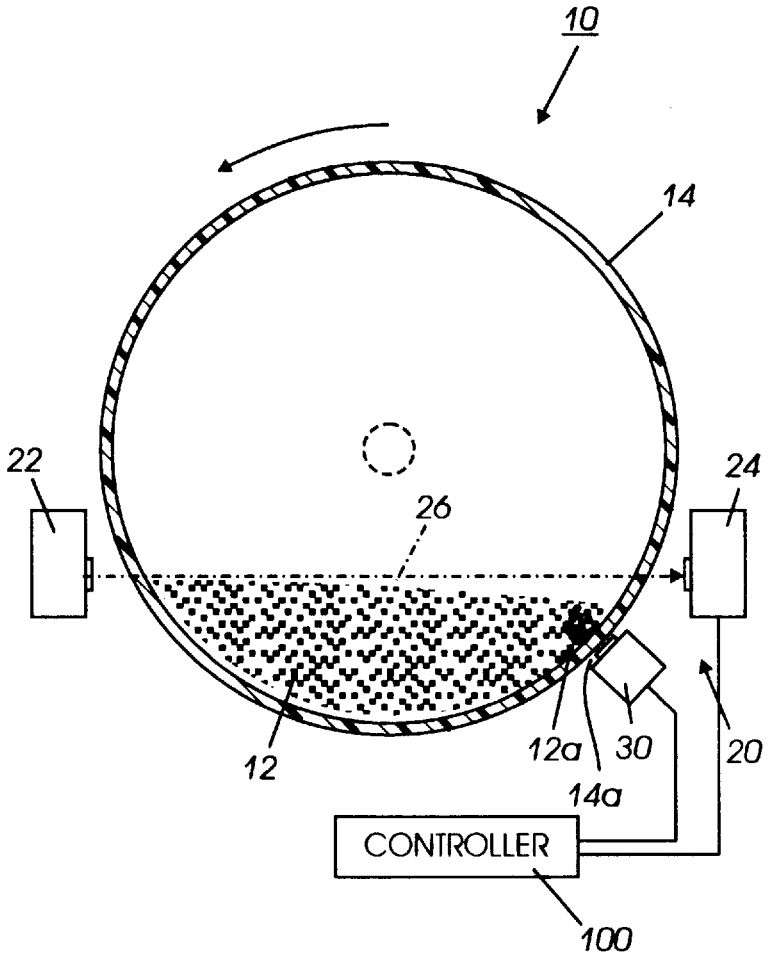
FIG. 2 is a schematic frontal view of one example of the subject imaging materials level sensing system when the container of FIG. 1, shown here in frontal end cross-section, is installed in an exemplary reproduction apparatus.
Figure 3:
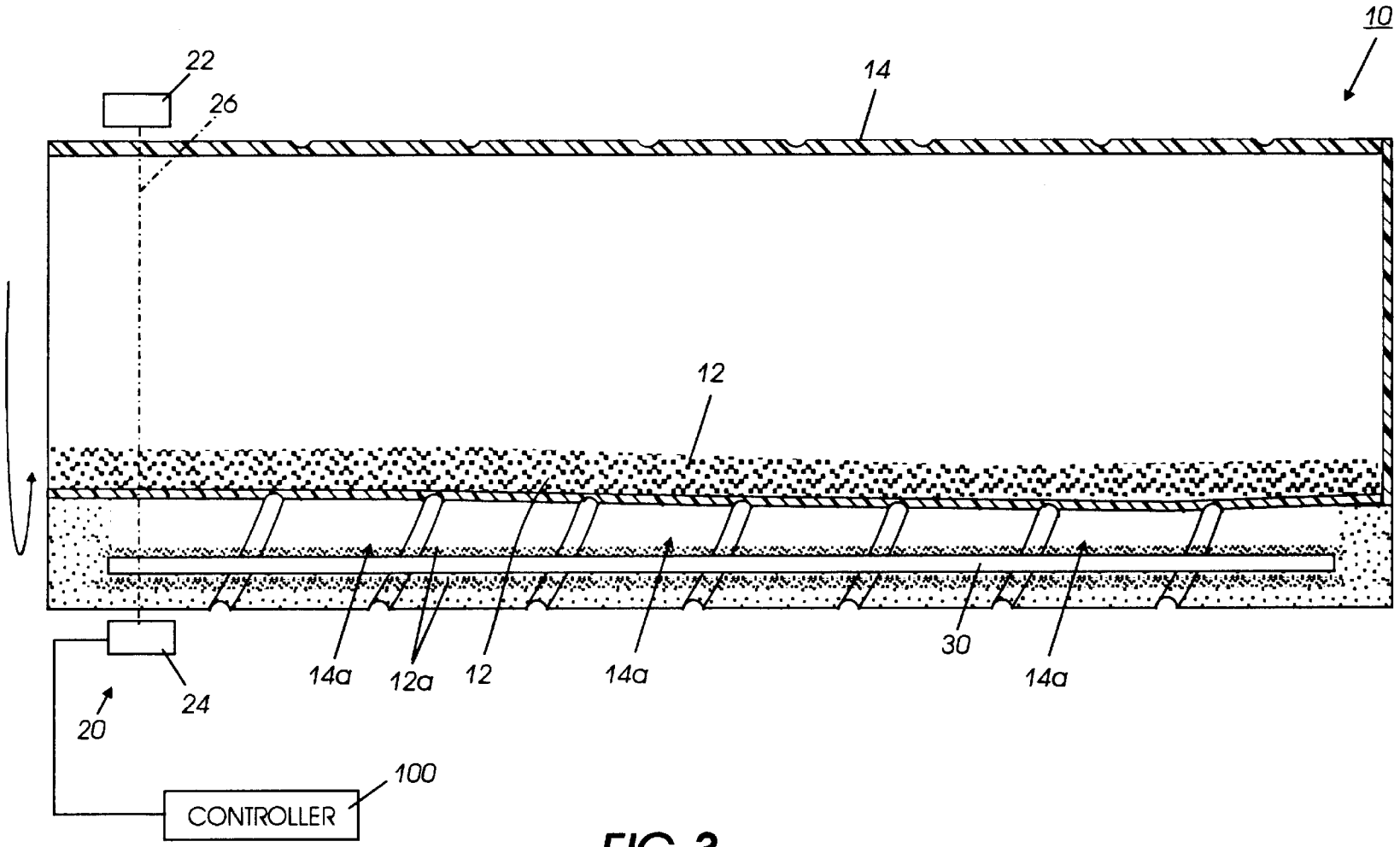
FIG. 3 is a schematic bottom view of the embodiment FIG. 2 with the container partially cross-sectioned for visibility therein.

Referring to FIGS. 2 and 3, it has been found that a two component optical sensing system 20 having an emitter 22 and a detector 24 on opposite sides of the toner container 14, to define an effective light beam 26 therebetween at a preset level through the lower portion of the container 14, provides a high signal to noise ratio. Since both the emitter 22 and detector 24 are completely outside of the toner container 14 they both also avoid toner contamination problems, as discussed above. Thus, the detection of the light from emitter 22 by the detector 24 signals to the machine controller 100 the absence of sufficient remaining toner in the container 14. Likewise, the sensed obstruction (preferably with a time delay or integration) of the light beam 26 by the detector 24 signals to the controller 100 the presence of sufficient remaining toner in the supply container 14. Various commercial components may be employed for the optical toner level sensing system 20 light emitter 22 and detector 24. For example, in this exemplary embodiment a commercial optical transmissive sensor 24 such as model 130K54561 from Optek Technology, Inc. may be utilized.

However, it was discovered as a significant problem in such an optical toner level sensing system 20 that toner adhering to the inside wall(s) of the container 14 can reduce the detectable optical radiance from the emitter 22 below the effective sensitivity of the detector 24, particularly if this optical sensing system 20 is used with toner containers 14 which are recycled or reused. Typical low cost cleaning processes do not remove this toner contamination from the inside walls of the container 14 sufficiently for this purpose. This toner contamination of the walls of the container 14 causing this optical beam 26 obstruction is believed to be caused by static electricity charges and toner additives. However, the particular theory of this toner adhesion problem is not important to the solution for it, which the present system provides. This toner contamination is not sufficiently removed by the rotation of the container 14 per se, or by thumping, tapping or other such typical mechanical agitation of toner containers as are used for toner dispensing assistance.

The toner container 14 here is conventionally a relatively thin walled container molded of a suitable conventional translucent plastic, such as high density polyethylene, so as to be sufficiently optically translucent for the optical sensing system 20 absent the above discussed toner contamination problem. It will be appreciated, however, that the container 14 need only be translucent in the area through which the light beam 26 passes.

The present system provides an automatically cleaned window area inside of the container 14, for optical transmission through both opposing walls thereof of the light beam path 26 of this optical sensing system 20. This is accomplished here by a simple fixed appropriately positioned magnet 30 interacting with a portion of the imaging material inside the container 14. The magnet 30 is positioned outside of, non-critically but relatively closely spaced from, the rotating toner container 14. The magnet 30 is positioned to extend along the axis of the container 14 over at least the area of the light beam path 26 of the optical sensing system 20, or, as shown in FIG. 3, the full length of the container 14. The magnet 30 has a magnetic field flux which extends inside the adjacent portion of the container 14 to form therein a magnetic brush 12*a* from a small quantity of the imaging material 12 which is magnetically attractable. There are known single component magnetic toner systems with which this system may be used. However, in this particular example, the toner is not ferrous and not magnetically attractable, but is mixed with carrier beads which are. This magnetic flux field can align and hold this carrier bead material therein. This example of a two component imaging material 12 with steel, ferrite, or other magnetically attractable carrier beads is typical of a so-called "trickle development" system, in which a small percentage of such carrier material is pre-mixed in and dispensed with the toner material to also gradually replace the carrier in the printer 10 development unit fed the material by the container 14. This magnetically attractable material is attracted towards the magnet 30, and thus towards, and held stationary against, the inside wall of the toner container 14 in at least the area 14*a* thereof, corresponding to the magnet 30 area.

As the container 14 rotates, this magnetic brush 12*a* sweeps or scrubs at least an annular clean window area 14*a* of corresponding width to the magnet 30 length inside the container 14. This cleaned, "see-through", window area 14*a* is where the light beam path 26 of the optical sensing system 20 passes through the container 14, and this overcomes the above-discussed toner contamination problems with the optical sensing system 20.

The size or strength of the magnet 30 is not critical, but is empirically selected to provide sufficient attractive force for adequate such cleaning for the optical sensing system 20 by the magnetic brush 12*a* without excessive friction or drag. That of course will vary depending on the particular imaging material and container, etc. The magnet 30 may be positioned as shown in FIG. 2, that is, positioned below the optical detector 24 and under the container 14, so as to form the magnetic cleaning brush 12*a* near the bottom of the container 14.

There is an additional feature and function of the magnet 30 or alternatives thereof not limited to cleaning a window area for the optical sensor. The magnet 30 can be used is to make sure that most or almost all of the imaging material is loosened and scraped off of the interior walls of the container 14, thus dropping towards the bottom of the container 14 and being dispensed. This lessen the excess undispensed and thus wasted material in the container before it is replaced, and which material otherwise needs to be cleaned out and recovered during the process of recycling the used container. To this end, the magnet 30 may optionally be made to extend for substantially the full axial length of the container 14, as shown in the bottom view of FIG. 3, to thereby form a magnetic cleaning brush 12*a* for the full length of the container interior. Furthermore, if the magnet is to be used only to help clean excess material out of the container in this manner it may be mounted in other radial positions around the container axis of rotation.

While the embodiments disclosed herein are presently preferred, it will be appreciated from this teaching that various alternatives, modifications, variations or improvements therein may be made by those skilled in the art, which are intended to be encompassed by the following claims:

We claim:

1. In a reproduction apparatus imaging material dispensing system with an imaging material dispensing container from which an at least partially magnetically attractable consumable imaging material is dispensed for said reproduction apparatus, with an imaging material level sensing system for sensing when there is an insufficient quantity of said imaging material remaining in said imaging material dispensing container, and wherein said imaging material dispensing container is a generally cylindrical tubular container which is rotatable driven for said dispensing, the improvement wherein:

a magnetic brush cleaning system is provided for internally cleaning said imaging material from the inside of said imaging material dispensing container, wherein said magnetic brush cleaning system comprises a stationary magnet mounted outside of and adjacent to said imaging material dispensing container to form a magnetic cleaning brush inside of said imaging material dispensing container by magnetically attracting said magnetically attractable consumable imaging material to said interior of said imaging material dispensing container to clean said interior of said imaging material dispensing container with said magnetic cleaning brush as said imaging material dispensing container is so rotatably driven;

wherein said stationary magnet corresponds in length to the length of said cylindrical imaging material dispensing container.

2. In a reproduction apparatus imaging material dispensing system with a removable imaging material dispensing container from which an at least partially magnetically attractable consumable imaging material is dispensed for said reproduction apparatus, with an imaging material level sensing system for sensing an insufficient quantity of said imaging material remaining inside said imaging material dispensing container, and wherein said imaging material dispensing container is a generally cylindrical tubular container which is rotatably driven for said dispensing, the improvement wherein:

a magnetic brush cleaning system is provided for internally cleaning said imaging material from said inside of said imaging material dispensing container, wherein said magnetic brush cleaning system comprises a stationary magnet separate from said imaging material dispensing container and mounted outside of and adjacent to said imaging material dispensing container to form a magnetic cleaning brush inside of said imaging material dispensing container by magnetically attracting said magnetically attractable imaging material to said inside of said imaging material dispensing container to clean said inside of said imaging material dispensing container with said magnetic cleaning brush as said imaging material dispensing container is rotatably driven;

wherein said rotatable imaging material dispensing container has a translucent wall comprising at least a translucent annular band thereof;

and wherein said imaging material level sensing system is separate from said imaging material dispensing container and comprises a stationary light emitter source positioned on one side of said imaging material dispensing container and a stationary light receiving sensor substantially spaced therefrom on an opposing side of said imaging material dispensing container for receiving and detecting a light beam extending from said light emitter source through said imaging material dispensing container to said light receiving sensor through said translucent annular band portion of said imaging material dispensing container;

wherein said stationary magnet is mounted in a position adjacent to said imaging material dispensing container to form said magnetic cleaning brush in a position for cleaning at least said translucent annular band of said imaging material dispensing container as said container is rotatably driven;

and wherein said stationary magnet is mounted in a position to form said magnetic cleaning brush substantially spaced away from said light beam extending from said light emitter source through said imaging material dispensing container to said light receiving sensor through said translucent annular band portion of said imaging material dispensing container.

* * * * *